US010773928B2

(12) United States Patent
Haikonen et al.

(10) Patent No.: US 10,773,928 B2
(45) Date of Patent: Sep. 15, 2020

(54) ELEVATOR LANDING DOOR LEAF

(71) Applicant: Kone Corporation, Helsinki (FI)

(72) Inventors: Aki Haikonen, Helsinki (FI); Mikko Kuronen, Helsinki (FI)

(73) Assignee: Kone Corporation, Helsinki (FI)

( * ) Notice: Subject to any disclaimer, the term of this patent is extended or adjusted under 35 U.S.C. 154(b) by 182 days.

(21) Appl. No.: 15/788,962

(22) Filed: Oct. 20, 2017

(65) Prior Publication Data

US 2018/0037441 A1 Feb. 8, 2018

Related U.S. Application Data

(63) Continuation of application No. PCT/EP2016/059351, filed on Apr. 27, 2016.

(30) Foreign Application Priority Data

Apr. 28, 2015 (EP) ..... 15165386

(51) Int. Cl.
*B66B 13/30* (2006.01)

(52) U.S. Cl.
CPC ..... *B66B 13/303* (2013.01)

(58) Field of Classification Search
CPC ..... B66B 13/303
See application file for complete search history.

(56) References Cited

U.S. PATENT DOCUMENTS 5,156,237 A * 10/1992 Hayashi ..... B66B 13/08 187/333
5,165,505 A 11/1992 Hayashi et al.
6,539,673 B1 * 4/2003 Ketonen ..... E06B 5/16 52/30
7,510,055 B2 * 3/2009 Morotome ..... B66B 13/30 187/400

FOREIGN PATENT DOCUMENTS

EP 0479239 A2 4/1992
EP 1391414 A1 2/2004
JP 01252485 A * 10/1989
JP 01252486 A * 10/1989

OTHER PUBLICATIONS

International Search Report PCT/ISA/210 for International Application No. PCT/EP2016/059351 dated Aug. 19, 2016.
Written Opinion of the International Searching Authority PCT/ISA/237 for International Application No. PCT/EP2016/059351 dated Aug. 19, 2016.
Extended European Search Report for European Application No. 15165386.2 dated Oct. 7, 2015.
Chinese Office Action dated Jan. 3, 2020 for Chinese Patent Application No. 2016800248589.

* cited by examiner

*Primary Examiner* — Diem M Tran
(74) *Attorney, Agent, or Firm* — Harness, Dickey and Pierce, P.L.C.

(57) ABSTRACT

The invention refers to an elevator door leaf comprising a door panel and a support structure having at least one profile. The door leaf comprises a vertically extending expansion member which is fixed to the door leaf only at one vertical level, whereby the expansion member consists of a material having a larger thermal expansion coefficient than the material of the door panel and/or of said profile.

23 Claims, 3 Drawing Sheets

40

48
30
48
42
10a
18
18
28
28
16
16
10b
24
24
14
22
22
14
20
20
44
46
32

ELEVATOR LANDING DOOR LEAF

This application is a continuation of PCT International Application No. PCT/EP2016/059351 which has an International filing date of Apr. 27, 2016, and which claims priority to European patent application number 15165386.2 filed Apr. 28, 2015, the entire contents of both of which are incorporated herein by reference.

BACKGROUND OF THE INVENTION

The present invention relates to an elevator door leaf which is used for car and/or landing doors in an elevator. The door leaf comprises at least one door panel and a support structure, e.g. a frame, with at least one profile, which advantageously extends vertically in the area of the leading side edge during the closing movement of the door leaf.

DESCRIPTION OF THE RELATED ART

Door leaves of the above mentioned type are common for elevator car doors or landing doors. Normally, in an elevator door leaf profiles are extending along the horizontal and vertical side edges of a door panel thus forming a rectangular frame which is covered by the door panel at one side, whereby the door panel usually encompasses the profiles of the rectangular door frame to provide a decorative surface visible for the passengers. A problem with these door leaves occurs in a common elevator landing door arrangement where the door leaves are supported on an upper support member in case of fire. Nowadays, most elevators have at least two door leaves which are moving in opposite directions. When during a fire the elevator landing door arrangement heats up, the upper support member tends to bend down in which case the abutting side edges of the two adjacent door leaves tend to open at the lower portion of the landing door arrangement thus opening a gap in the form of a turn-around V. Now fire can get through that V gap from the elevator shaft into the landing/car or vice versa.

SUMMARY OF THE INVENTION

It is therefore object of the present invention to provide a door leaf and a landing/car door arrangement of an elevator which offers a better protection in case of fire.

The object is solved with a door leaf according to claim 1, as well as with an elevator door arrangement to claim 11. Some inventive embodiments of the invention are also described in the descriptive section of the present application or in the drawings. The inventive content may also consist of several separate inventions, especially if the invention is considered in the light of expressions or implicit subtasks or from the point of view of advantages achieved. In this case, some of the attributes contained in the claims below may be superfluous from the point of view of separate inventive concepts.

According to the invention the door leaf having a door panel and a support structure with at least one profile comprises at least one vertically extending expansion member which is fixed to the door leaf only at one vertical level, whereby the expansion member consists of a material having a larger thermal expansion coefficient than the material of the door panel and/or of said profile. In this inventive door leaf, the expansion profile preferably abuts or is above the bottom edge of the profile and/or door leaf at room temperature or is located in the vicinity thereof.

When a fire breaks out, the door leaf heats up whereby the expansion member—which has a larger thermal expansion coefficient than the profile and door panel and the support structures of the door leaf which are usually made of steel metal—expands and therefore projects from the bottom edge of the door leaf where it can interact with the floor structure and/or with a door sill. Therefore, the expansion member which is preferably fixed only at one vertical level, preferably at its upper end to the profile and/or any other structure of the door leaf projects from the bottom edge of the door leaf and thus gets into interaction with the floor or door sill as to keep the leading side edge of the door leaf in opening/closing direction immovable with respect to the floor or door sill. The fixing can be performed with a bolt, or simply by form interlocking or by any other well-known techniques to keep two parts mutually immovable at one point. Via this measure, the building of a V gap between two adjacent door leaves moving in opposite directions is prevented as both door leaves are fixed with their adjacent and abutting side edges horizontally immovable to the floor or door sill. Thus, the inventive door leaf provides a much better fire protection than common door leaves.

Preferably the profile is a vertical extending longitudinal profile, preferably in the area of a side edge of the door leaf, and that the expansion member is located in connection with said profile. This provides a sufficiently rigid structure to block any opening movement of the door leaf after the expansion member protrudes and engages the floor or door sill.

Preferably, the profile is a hollow profile and that the expansion member is located inside the hollow profile which has the advantage that a hollow profile offers a better stability to the door leaf than an open profile. Furthermore, the hollow profile offers a possibility to place the expansion member completely inside of the hollow profile so that expansion member does not interfere with any other component of the door leaf or of the door arrangement.

Preferably, the profile is the vertical profile of the door frame which forms the support structure of the door leaf. In this case the vertical profile is preferably located on the leading side edge of the door leaf during closing movement of the door leaf.

Preferably, the hollow profile is a rectangular profile which is easy to manufacture and easy to use in the construction of the door leaf because one side of the rectangular profile may be easily connected with a flat surface to the door panel of the door leaf.

Whereas it is possible to close the hollow profile at its lower end via a cover which can easily be penetrated by the expansion member when it is expanding because of fire, it is preferable that the hollow profile is open at its lower end. Of course, a cover may be put to the lower end, e.g. made of plastics, which is easily destroyed in case of fire so that the lower end of the expansion member is not prevented to protrude from the bottom edge of the door leaf.

Preferably, the expansion member is located inside the hollow profile as it has already been mentioned above.

In an advantageous embodiment of the invention the profile is made of steel and the expansion member is made of aluminium, which can comparably easy and economically manufactured and mounted in the door leaf.

Preferably, the expansion member is a beam, preferably a massive beam, because it has a rigid structure able to transfer the vertical blocking forces to the floor or door sill.

As usually the door panel and support structure of a door leaf are made of metal or metal alloy (e.g. stainless steel) the expansion member comprises aluminium, magnesium or a composite structure having FI-Block® material, which materials are fireproof and have a larger thermal expansion coefficient than steel or its alloys.

Preferably, the expansion member is located in connection with the leading profile located at the leading side edge of the door leaf when moving in closing direction, because these are the edges meeting the side edge of a door leaf running in opposite direction, between which the V-gap is formed. The expansion member is thereby preferably only fixed at its upper end to the door leaf, particularly to the leading profile, which has the advantage that the complete expansion difference leads to the expansion member's protrusion from the bottom end of the door leaf and therefore to a better grip with the floor or door sill. The same holds true if only the expansion member (without a profile) is located in the area of a side edge of the door leaf, preferably of the leading edge of the door leaf in its closing direction. Of course also an advantageous effect is achieved when the expansion member is not located in the vicinity of the leading edge but somewhat apart.

Preferably, the lower end of the expansion member abuts at room temperature with the lower edge of the profile and/or with a bottom door edge of the door leaf so that the expansion member does not protrude from the bottom edge of the door leaf which might cause problems during normal operation of the landing door. On the other hand, it is ensured that instantly when the landing door heats up to temperatures above room temperature, the expansion member immediately starts to protrude from the bottom edge of the door leaf in the direction of the floor or door sill, so that the whole expansion of the expansion member is transferred into protrusion from the bottom edge of the door leaf. This ensures that during critical temperatures of e.g. 300 to 500° C., the expansion member protrudes via a distance d which is large enough to counteract with the floor or door sill to horizontally fix the corresponding side edge of the door leaf to the door sill. This distance d may for example be 15 mm at a temperature of 400° C.

The invention is based on the principle that the profile and/or the complete structure of the door leaf has a lower thermal expansion coefficient than the expansion member. As for the material of the door leaf structure, usually steel-based alloys are used, particularly stainless steel whereas aluminium or a similar material having a larger thermal expansion coefficient than steel may be used for the expansion member.

Preferably, the expansion member is a massive member which is able to apply enough force to the floor or door sill to keep the side edge of the door leaf immovable in horizontal direction or opening direction of the door leaf which is a key feature to prevent the building of a V gap between two adjacent door leaves of the landing door moving in opposite directions.

Preferably, the leading profile is part of a door leaf frame supporting the door panel of the door leaf. Via this measure, no additional structures, particularly no additional profile has to be provided for the accommodation of the expansion member.

The invention further refers to an elevator door arrangement comprising an upper support member carrying at least one door leaf according to the above-mentioned specifications. The door arrangement further comprises a door sill or a floor at the bottom of the door leaf. The floor or door sill hereby comprises a structure which is configured to co-act with the lower end of the expansion member to prevent horizontal movement of the expansion member (in opening direction of the door leaf) with respect to the floor or door sill. By this measure, it is ensured that the building of a gap between two adjacent door leaves cannot occur as both facing and abutting side edges of the adjacent door leaves are kept immovable with respect to the floor or door sill and therefore kept closed also in case of fire or extensive heating.

Preferably, the upper support member carries at least two door leaves moving in opposite directions whereby the profile and the expansion member of each door leaf is located at the leading side edge of the door leaf in its closing direction which leading side edge abuts against the side edge of the door leaf moving in opposite direction when the elevator door is closed. Therefore, even being adapted to be used in car doors and/or landing doors with only one door leaf, the invention is preferably designed for elevator car doors and/or landing doors having two door leaves moving in opposite directions or four door leaves whereby a set of two or three telescopic door leaves moves in one direction. Anyway, the formation of a V gap during heating of the elevator door arrangement always occurs only between the facing and abutting side edges of the two adjacent door leaves moving in opposite direction. It is clear that the expansion members have only to be provided at these two side edges of the door leaves and not at any side edge of the other door leaves. Therefore, the thermal expansion members have only to be provided at those door leaves which come into contact with door leaves moving in opposite direction.

Preferably, the structure of the floor or door sill comprises at least one structure, e.g. recess, e.g. in a guide groove, which structure fixes the lower end of the expansion member in horizontal direction. Such a structure may be a saw-tooth structure or a sinusoidal structure which matches with a corresponding counter-structure at the lower end of the expansion member. The counter-structure may e.g. be a tip or a corresponding saw-tooth structure. Accordingly, the structure in floor or door sill, e.g. in the guide groove co-acts with the lower end of the expansion member so that this is not movable with respect to the floor, e.g. within the guide groove, horizontally in opening direction. The arrangement of the structure within the guide groove further ensures that the structure of the floor or door sill does not cause problems during normal operation of the elevator.

The invention of course also relates to an elevator having at least one door leaf according to the above specifications and/or an elevator door arrangement according to the above specifications. It is clear for the skilled person that a corresponding landing door arrangement is provided in each landing door of the elevator to provide the required fire resistance homogeneously throughout the complete building as well as in all elevator cars.

It is clear for the skilled person that the above embodiments can be arbitrarily mixed with each other.

It is further apparent for the skilled person that components of the invention as mentioned in the claims may be provided as a single component or as multiple components unless their number is explicitly mentioned in the claim. Following synonyms are used in the description: "elevator door leaf"="door leaf", "profile" (without specification) ="leading profile".

BRIEF DESCRIPTION OF THE DRAWINGS

The invention is now described via an example in the enclosed schematic drawings.

DESCRIPTION OF THE PREFERRED EMBODIMENTS

Figure 1:
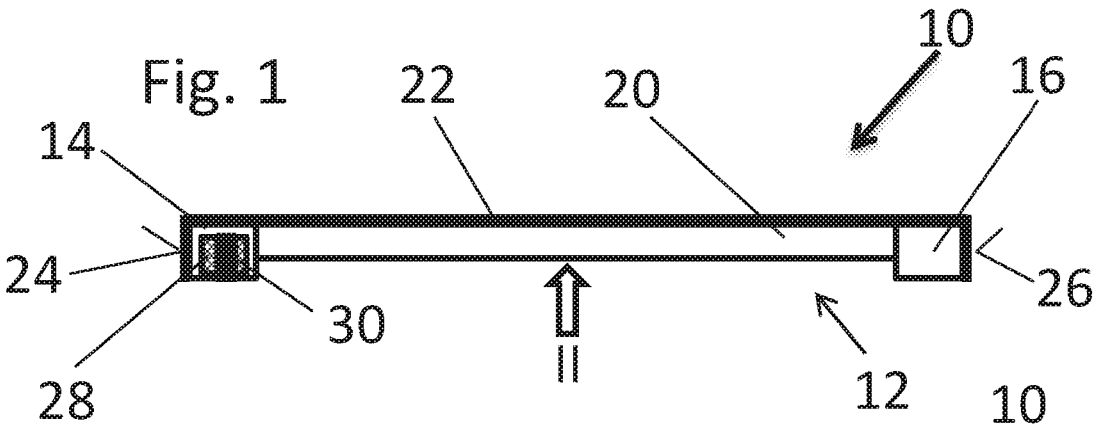
FIG. 1 shows a horizontal cross-section through an inventive door leaf.
Figure 2:
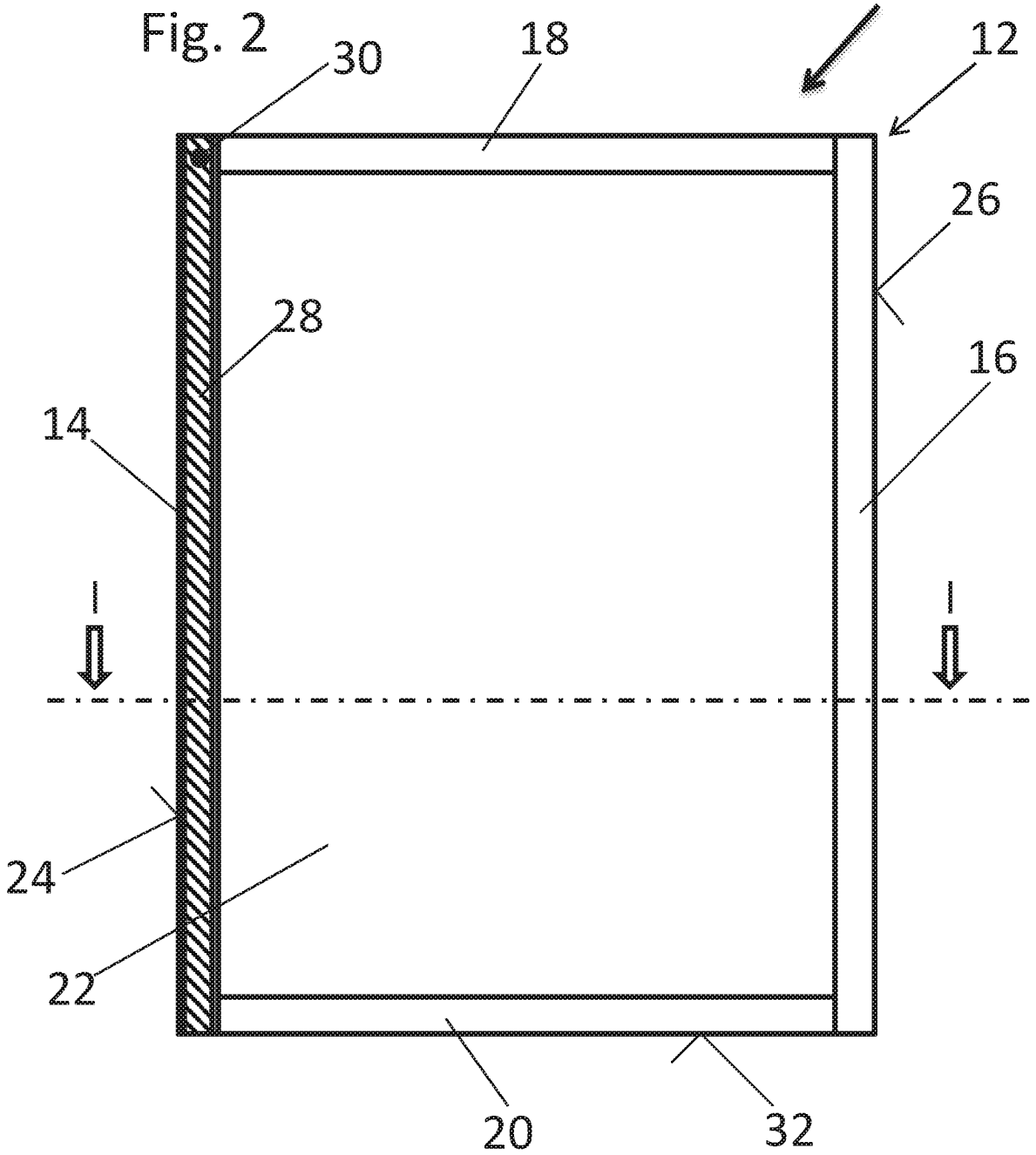
FIG. 2 shows the side view II from FIG. 1.
Figure 3:
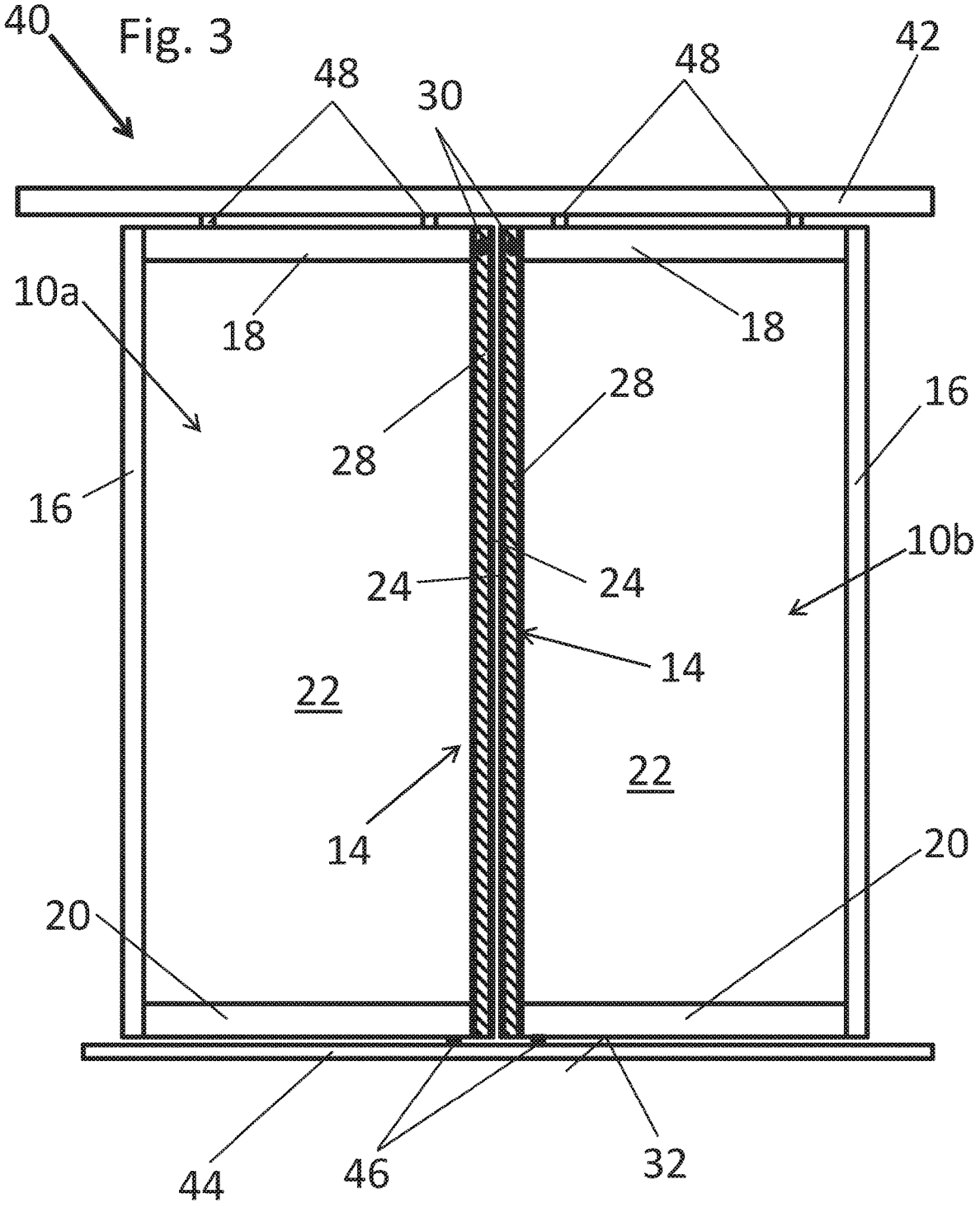
FIG. 3 shows an elevator door arrangement with two door leaves according to FIGS. 1 and 2 moving in opposite directions.

The inventive door leaf 10 of an elevator door is now described via FIGS. 1 and 2. The door leaf 10 comprises a frame 12 comprising of a vertical leading profile 14 and a vertical trailing profile 16 (referring to closing movement of the door leaf) and a horizontal upper profile 18 and a horizontal lower profile 20, whereby all profiles 14, 16, 18, 20 are connected at their ends to build a rectangular frame 12. This frame 12 carries a door panel 22 which encompasses the vertical profiles 14, 16 as to provide a decorative surface to the passengers. All profiles 18, 20, 14, 16 are hollow rectangular profiles made of steel-based metal, preferably stainless steel. The door leaf 10 has a vertical leading edge 24 and a vertical trailing edge 26 when the door moves in closing direction. In the profile 14 adjacent to the leading edge 24, a thermal expansion member 28 is accommodated which is fixed at its upper end, via a fixing member, e.g. a bolt 30 to the hollow rectangular leading profile 14 of the leading edge 24. The expansion member may also be fixed to any other part of the door leaf structure by any common connecting technique. At room temperature, the lower end of the thermal expansion member 28 abuts with the bottom edge 32 of the door leaf. But it also may offset a little bit with respect to the bottom edge 32 of the door leaf 10, e.g. by 5 mm. Usually, such a door leaf 10 as shown in FIGS. 1 and 2 is carried by an upper support member 42 of an elevator door arrangement 40 as it is shown in FIG. 3. In this embodiment the bottom edge 32 of the door leaf 10 faces a door sill 44.

During heating of the door leaf 10, e.g. because of fire in the building or any other heat generating accident, the expansion member 28 which has a larger thermal expansion coefficient than the surrounding hollow leading profile 14 begins to protrude from the bottom edge 32 of the door panel downwards and thus co-acts with the door sill to keep the trailing edge 24 of the door leaf 10 immovable with respect to the door sill 44 in horizontal direction or in opening direction. Via this measure, the forming of an open gap between door leaves 10*a*, 10*b* or the door leaf and a door jamb during fire can be effectively prevented.

FIG. 3 shows an elevator door arrangement 40, e.g. of an elevator car or elevator landing, comprising an upper support member 42 which carries two door leaves 10*a*, 10*b* which are movably supported on the upper support member 42 in opposite directions as to be centrally opening. The door leaves 10*a*, 10*b* are guided in grooves of a door sill 44 located below the bottom edge 32 of the door leaves 10*a*, 10*b*. On this behalf, guide pins 46 of the door leaf 10 protrude from the bottom edge 32 thereof and extend into the corresponding guide groove of the door sill 44. Instead of only two door leaves 10*a*, 10*b*, also four or six door leaves can be arranged whereby in this case two or three door leaves move in the same direction with different velocity in a telescopic way. The thermal expansion members 28 are in this case only provided in those door leaves 10*a* whose leading side edge 24 comes into contact with a leading side edge 24 of a door leaf 10*b* moving in opposite direction.

The door leaves 10*a*, 10*b* are supported by the upper support member regularly via supporters 48 which extend from the door leaves 10*a*, 10*b* to the upper support member 42 and which supporters 48 carry rollers running in a track of the support member 42 (not shown). At least one of the supporters 48 is usually connected with a drive to move the door panel 10*a*, 10*b* horizontally with respect to the upper support member 42.

Figure 4:
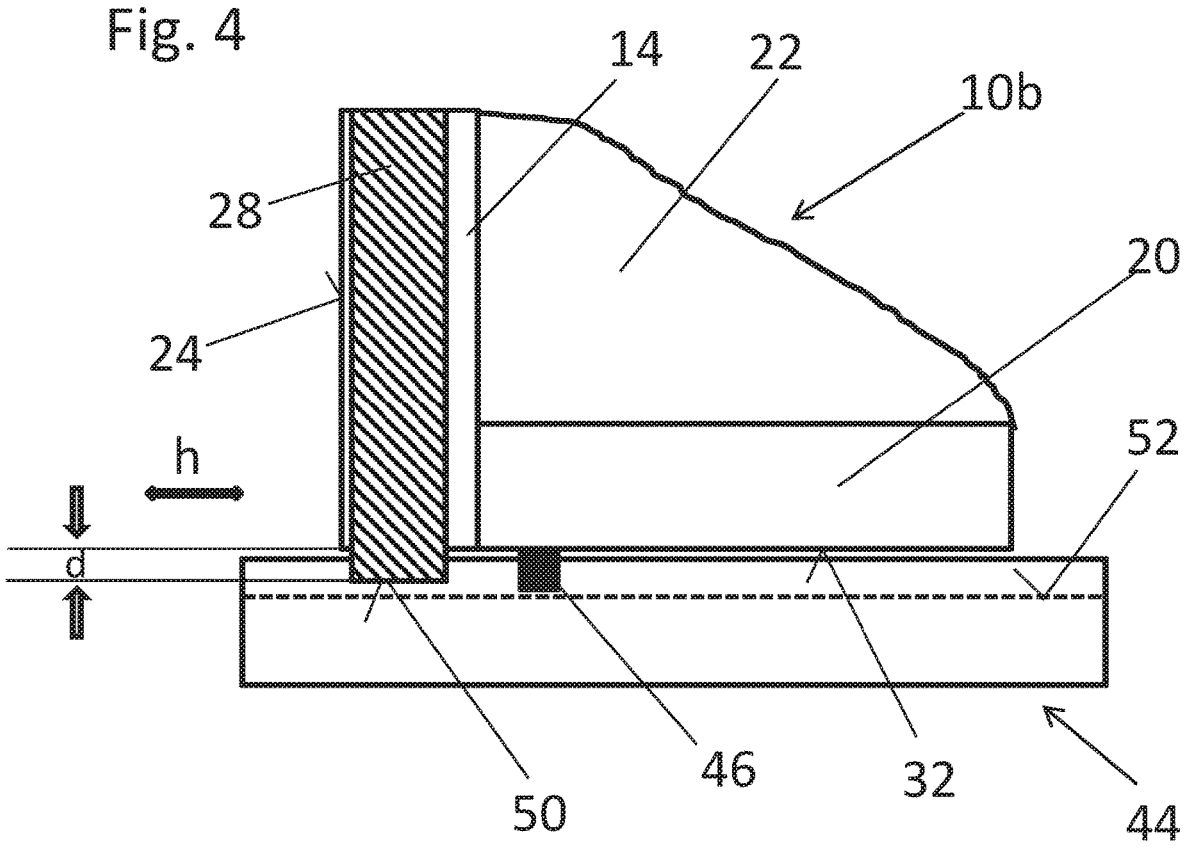
FIG. 4 shows a detail of the door arrangement of FIG. 3 between door leaf and door sill.

FIG. 4 shows a detail of the lower end of the door leaf 10*b* and the door sill in the area of the expansion member 28. In the drawings, the same reference numerals are used for elements which are identical or have the same function.

FIG. 4 shows the arrangement of one door leaf 10*b* and the door sill 44 in case of a heating of the landing door arrangement 40 to about 400°. In this case, the expansion member 28 protrudes with its lower end 50 from the bottom edge 32 of the door leaf 10*b* downwards by a distance d and thus grips into the guide groove 52 of the door sill 44. The guide groove is normally provided for guiding the guide pins 46 of the door leaves 10*a*, 10*b* in opening/closing direction h.

The expansion member 28 may have e.g. a wedge shape at its lower end 50 so that it presses into the guide groove 52 of the door sill 44 with a friction grip which renders the expansion member 28 immovable in opening/closing direction h. Therefore, the corresponding vertical profile 14 of the door leaf 10*b* at the leading edge 24 is kept immovable in opening/closing direction h and thus no gap can be formed between the facing trailing side edges 24 of both door leaves 10*a*, 10*b*. Therefore, also in case of fire or higher temperatures where the upper support member may bend down, the adjacent leading edges 24 of both door leaves 10*a*, 10*b* keep in contact with each other so that no gap is formed through which the fire or heat might pass.

Figure 5:
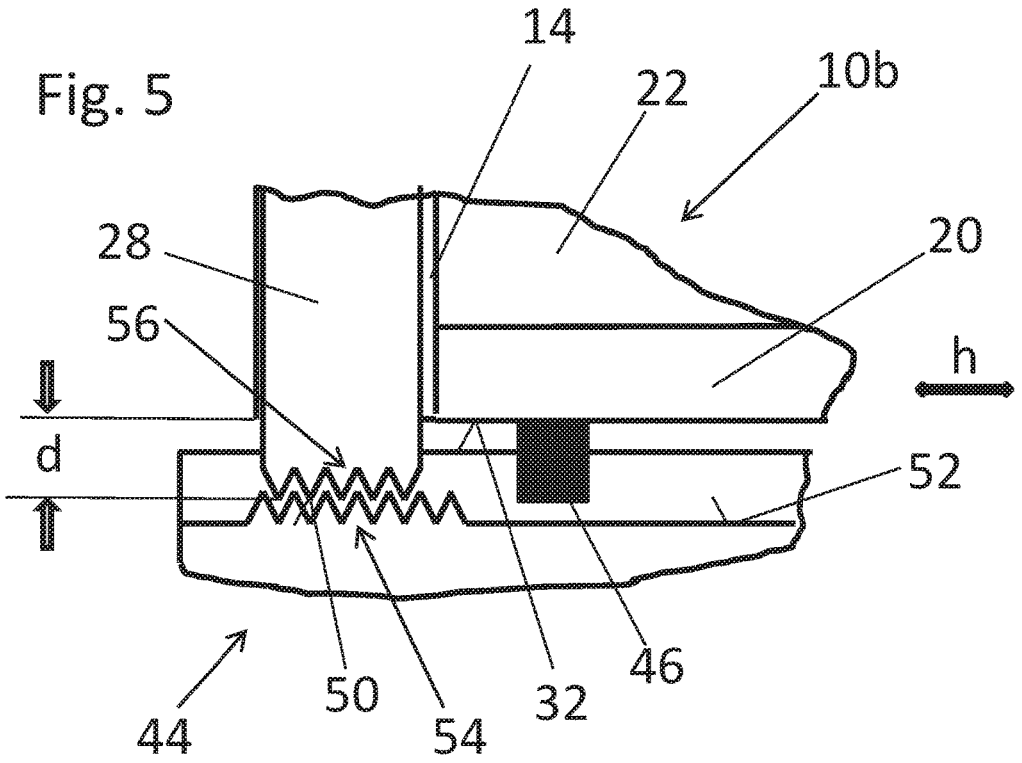
FIG. 5 shows a schematic illustration of the co-action between the lower end of the expansion member and a saw-tooth structure in the guide groove of a door sill.

FIG. 5 shows a further embodiment of the guide groove 52 and the lower end 50 of the expansion member. In the area of the lower end 50 of the expansion member 28, the surface of the guide groove 52 of the door sill 44 has a first saw-tooth structure 54 which matches with a second saw-tooth structure 56 located at the lower end 50 of the expansion member 28. Therefore, when the expansion member 28 protrudes by a certain distance from the bottom edge 32 of the door leaf 10*b*, it interacts with the first saw-tooth structure 54 of the guide groove 52 whereby the expansion member 28 is fixed to the door sill 44 in opening/closing direction h.

Of course, this arrangement is provided also with the other door leaf 10*a* of the elevator landing door arrangement 40 of FIG. 3.

The structure to keep the expansion member 28 immovable might differ from the shown saw-tooth structure 54. Other structures may have sinusoidal geometries or even one or more recesses in the guide rail groove 52 which interacts with one pin, preferably cone-shaped pin, at the lower edge 50 of the expansion member 28. The structure may also be provided directly on the floor without any guide groove.

The invention is not limited to the described embodiments but can be varied within the scope of the appended patent claims.

LIST OF REFERENCE NUMBERS

10 door leaf
10*a* left door leaf
10*b* right door leaf

12 frame
14 leading profile
16 trailing profile
18 upper profile
20 lower profile
22 door panel
24 leading edge
26 trailing edge
28 expansion member
30 fastening bolt
32 bottom edge of door leaf
40 elevator door arrangement
42 upper support member
44 door sill
46 guide pin
48 supporter
50 lower end of expansion member
52 guide groove
54 first saw-tooth structure of door sill
56 second saw-tooth structure of expansion member

The invention claimed is:

1. An elevator door leaf comprising:

a door panel;

a support structure configured to carry the door panel, the supporting structure including at least one profile; and a vertically extending expansion member extending vertically from a top of the support structure to a bottom of the support structure in a direction of a length of the elevator door leaf such that only an upper end of the vertically extending expansion member is fixed to the top of the support structure, a material of the vertically extending expansion member having a larger thermal expansion coefficient than a material of one or more of the door panel and the at least one profile such that, in response to expansion of the vertically extending expansion member, a lower end of the vertically extending expansion member is repositioned from a first position to a second position downwards towards a door sill at a bottom of the elevator door leaf, the first position being a position in which the vertically extending expansion member does not interact with the door sill and the second position being a position in which the vertically extending expansion member interacts with the door sill.

2. The elevator door leaf according to claim 1, wherein, in response to a temperature of the expansion member reaching a critical temperature, the vertically extending expansion member is configured protrude a distance d from a bottom edge of the elevator door leaf to interact with the door sill to horizontally fix a side edge of the elevator door leaf to the door sill.

3. The elevator door leaf according to claim 2, wherein the at least one profile is at a leading edge of the elevator door leaf in a closing direction of the elevator door leaf.

4. The elevator door leaf according to claim 1, wherein the at least one profile vertically extends in an area of a side edge of the elevator door leaf, and the vertically extending expansion member is within the at least one profile.

5. The elevator door leaf according to claim 4, wherein the at least one profile is a hollow profile and that the vertically extending expansion member is located inside the hollow profile.

6. The elevator door leaf according to claim 4, wherein the material of the at least one profile is steel, and the material of the vertically extending expansion member is aluminium.

7. The elevator door leaf according to claim 1, wherein the vertically extending expansion member is at a leading side edge of the elevator door leaf in a closing direction of the elevator door leaf.

8. The elevator door leaf according to claim 1, wherein only the upper end of the vertically extending expansion member is fixed to the elevator door leaf.

9. The elevator door leaf according to claim 1, wherein the vertically extending expansion member is a beam.

10. The elevator door leaf according to claim 1, wherein, at room temperature, the lower end of the vertically extending expansion member is positioned in the first position abutting with a lower end of the at least one profile and/or with a bottom edge of the elevator door leaf.

11. The elevator door leaf according to claim 1, wherein the material of the expansion member includes aluminium, magnesium or a composite structure having FI-Block® material.

12. An elevator door arrangement comprising:

an upper support member carrying the elevator door leaf according to claim 1; and the door sill at the bottom of the elevator door leaf, the door sill including a structure configured to interact with the lower end of the vertically extending expansion member.

13. The elevator door arrangement according to claim 12, wherein the structure includes at least one recess in the door sill, and the lower end of the vertically extending expansion member is configured to interact with the at least one recess in the door sill.

14. The elevator door arrangement according to claim 12, wherein the elevator door leaf includes at least two elevator door leaves configured to move in opposite directions while being carried by the upper support member, and the profile and the vertically expending expansion member of each of the at least two elevator door leaves being located at a side edge of respective ones of the at least two elevator door leaves which, when the door panel is closed, a first one of the at least two elevator door leaves abuts against a side edge of a second one of the at least two elevator door leaves moving in an opposite direction.

15. The elevator door arrangement according to claim 12, wherein the structure includes a guide groove of the door sill, and the lower end of the vertically extending expansion member is configured to interact with the guide groove in the door sill.

16. The elevator door leaf according to claim 1, wherein a lower end of the vertically extending expansion member has a first surface having a first shape, and the door sill has second surface having a second shape such that the first surface and the second surface interlock in response to expansion of the vertically extending expansion member downwards towards the door sill.

17. The elevator door leaf of claim 16, wherein upon expansion of the vertically extending expansion member downwards towards the door sill, the upper end of the expansion member is fixed to the elevator door leaf and the lower end of the expansion member is fixed to the door sill.

18. The elevator door arrangement of claim 14, wherein upon expansion of the vertically extending expansion member associated with each of the at least two elevator door leaves downwards towards the door sill, the upper end of the vertically extending expansion member of each of the at least two elevator door leaves is fixed to a respective one of the at least two elevator door leaves and the lower end of the vertically extending expansion member of each of the at least two elevator door leaves is fixed to the door sill.

19. The elevator door leaf according to claim 1, wherein the lower end of the expansion member is configured to selectively extend from the first position to the second position below the bottom of the support structure to interact with at least one recess in the door sill at the bottom of the elevator door leaf.

20. The elevator door leaf according to claim 1, wherein the at least one profile includes at least a first horizontal profile and a second horizontal profile connected to a top and a bottom of the door panel, respectively, and at least one vertical profile extending vertically from the first horizontal profile to the second horizontal profile such that a top of the at least one vertical profile is connected to the first horizontal profile; and the vertically extending expansion member extends vertically from the first horizontal profile to the second horizontal profile in the direction of the length of the elevator door leaf such that only the upper end of the vertically extending expansion member is fixed to the top of the at least one vertical profile the elevator door leaf.

21. An elevator comprising:

at least one elevator door leaf according to claim 1.

22. The elevator door arrangement comprising:

at least one door elevator leaf according to claim 12.

23. An elevator door leaf comprising:

a door panel;

a support structure configured to carry the door panel, the supporting structure including at least one profile; and an expansion member at a leading side edge of the elevator door leaf in a closing direction of the elevator door leaf, the expansion member extending vertically from a top of the support structure to a bottom of the support structure in a direction of a length of the elevator door leaf such that only an upper end of the expansion member is fixed to the top of the support structure, a material of the expansion member having a larger thermal expansion coefficient than a material of one or more of the door panel and the at least one profile.

* * * * *